US008040755B2

(12) United States Patent
Priest

(10) Patent No.: US 8,040,755 B2
(45) Date of Patent: Oct. 18, 2011

(54) WIRED PIPE DEPTH MEASUREMENT SYSTEM

(75) Inventor: John F. Priest, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 1084 days.

(21) Appl. No.: 11/846,276

(22) Filed: Aug. 28, 2007

(65) Prior Publication Data

US 2009/0059722 A1 Mar. 5, 2009

(51) Int. Cl.
*E21B 47/16* (2006.01)

(52) U.S. Cl. ..... 367/82; 340/854.1; 340/854.4; 340/854.9

(58) Field of Classification Search ..... 340/854.1, 340/854.2, 870.25, 870.26; 367/81, 82, 99, 367/15, 33, 48, 118, 124, 125; 166/64, 255.1; 73/152.01–152.62; 702/6, 9; 324/642
See application file for complete search history.

(56) References Cited

U.S. PATENT DOCUMENTS 3,490,149 A 1/1970 Bowers
4,544,242 A 10/1985 Schindl
4,803,479 A * 2/1989 Graebner et al. ..... 340/854.1
5,541,587 A * 7/1996 Priest ..... 340/854.1
7,301,853 B2 * 11/2007 Coffey ..... 367/99

FOREIGN PATENT DOCUMENTS

EP 160356 A1 * 11/1985
GB 2329722 A 3/1999

* cited by examiner

*Primary Examiner* — Timothy Edwards, Jr.
*Assistant Examiner* — Franklin Balseca
(74) *Attorney, Agent, or Firm* — Cantor Colburn LLP

(57) ABSTRACT

A method and apparatus for estimating a change in length of a wellbore conveyance device in a wellbore. A reference signal is sent along a first path and a wellbore signal having a phase relationship with the reference signal is sent along a wellbore path. A change in length of the wellbore conveyance device is estimated from a phase shift between the reference signal and the wellbore signal. The frequency of the wellbore signal may be changed downhole. The wellbore conveyance device may have at least one conductor under a maintained tension. A length of the wellbore conveyance device is estimated from the estimated change in the length. For a drill string composed of a plurality of wellbore tubulars, a phase shift of the drill sting is determined upon adding a wellbore tubular to the drill string.

20 Claims, 5 Drawing Sheets

WIRED PIPE DEPTH MEASUREMENT SYSTEM

BACKGROUND OF THE DISCLOSURE

1. Field of the Disclosure

The present invention relates to the field of depth measurement in a wellbore. In particular, the present invention relates to measuring distances down-hole by observing a phase shift associated with a signal traversing a signal conductor associated with a wellbore tubular.

2. Description of the Related Art

Oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. The drill pipe is made of jointed pipes. Alternatively, coiled tubing may be utilized to carry the drilling of assembly. The drilling assembly also includes a variety of sensors for taking measurements of a variety of drilling, formation and BHA parameters. Exemplary tools include measurement while drilling (MWD) tools. As is known, it is often necessary to know the drill bit depth, from which is usually derived the hole depth and the tool depth of MWD tools. Conventional depth estimates are generally based on surface measurements, either using a pipe stand length or a pipe travel measurement (from the draw works for example) or both and a periodic survey points (surveys). The pipe travel is generally referred to as rate of penetration, ROP, and is generally provided in m/hr or ft/hr. To the surface measurements, various corrections are made for pipe stretch, temperature, non-linearities in the pipe travel measurements, etc.

While conventional depth measurements systems have been adequate in certain applications, there is an ever present need for more cost-effective and accurate depth measurement systems.

SUMMARY OF THE DISCLOSURE

The present disclosure provides a method and apparatus for estimating a change in length of a wellbore conveyance device in a wellbore. In one aspect, the method includes: sending a reference signal along a first path; sending a wellbore signal having a phase relationship with the reference signal along a wellbore path along the wellbore conveyance device; and estimating a change in length of the wellbore conveyance device from a phase shift between the reference signal and the wellbore signal. Additionally, the method may include using one of (i) a single wire and (ii) at least two wires for the wellbore path. In one aspect, the frequency of the wellbore signal is changed downhole. The changed frequency may be an integer multiple of the frequency of the reference signal. The wellbore conveyance device further include a wellbore tubular having at least one conductor, the method further including maintaining a tension on the at least one conductor. The method further includes estimating a length of the wellbore conveyance device from the estimated change in the length.

The present disclosure also provides an apparatus for estimating a change in length of a wellbore conveyance device in a wellbore that includes: a signal generator configured to send a reference signal along a surface path and a wellbore signal having a phase relationship with the reference signal along a path in the wellbore; a phase angle discriminator configured to estimate a phase shift between the reference signal and the wellbore signal; and a processor configured to estimate a change in length of the wellbore conveyance device from the phase shift. In one aspect, the apparatus further includes at least one signal conductor receiving the wellbore signal from the signal generator, the at least one signal generator being positioned along the path in the wellbore. The at least one signal conductor may be a single signal conductor configured to convey the wellbore signal downhole and uphole. In another aspect, the apparatus includes a phase locked loop positioned in the wellbore and receiving the wellbore signal from the signal generator, the phase locked loop being configured to change a frequency of the wellbore signal downhole. The changed frequency may be an integer multiple of the frequency of the reference signal. In another aspect, the wellbore conveyance device is a wellbore tubular. The processor estimates a length of the wellbore conveyance device from the estimated changes in the length.

The disclosure further provides a method for determining a length of a drill string in a wellbore that includes: forming the drill string using a plurality of wellbore tubulars having at least one signal conductor; drilling the wellbore with the drill string; conveying a signal along the at least one signal conductor; determining a phase shift between the signal and a reference signal; and estimating a length of the drill string using the determined phase shift. In one aspect, the signal has a phase relationship with the reference signal. In the method, the at least one conductor includes a single conductor and wherein the signal is conveyed downhole and uphole along the single conductor. The method may further include: adding a wellbore tubular to the drill string: and determining a phase shift of the drill string with the added wellbore tubular. Also, the method may further include determining a length of the wellbore tubular added to the drill string; and updating a recorded length of the drill string. The method may further include: stopping drilling before adding the wellbore tubular to the drill string; determining a phase shift of the drill string after the wellbore tubular has been added to the drill string; and continuing drilling after adding the wellbore tubular to the drill string.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

The present invention is best understood with reference to the accompanying figures in which like numerals refer to like elements and in which.

DETAILED DESCRIPTION OF THE DISCLOSURE

Figure 1:
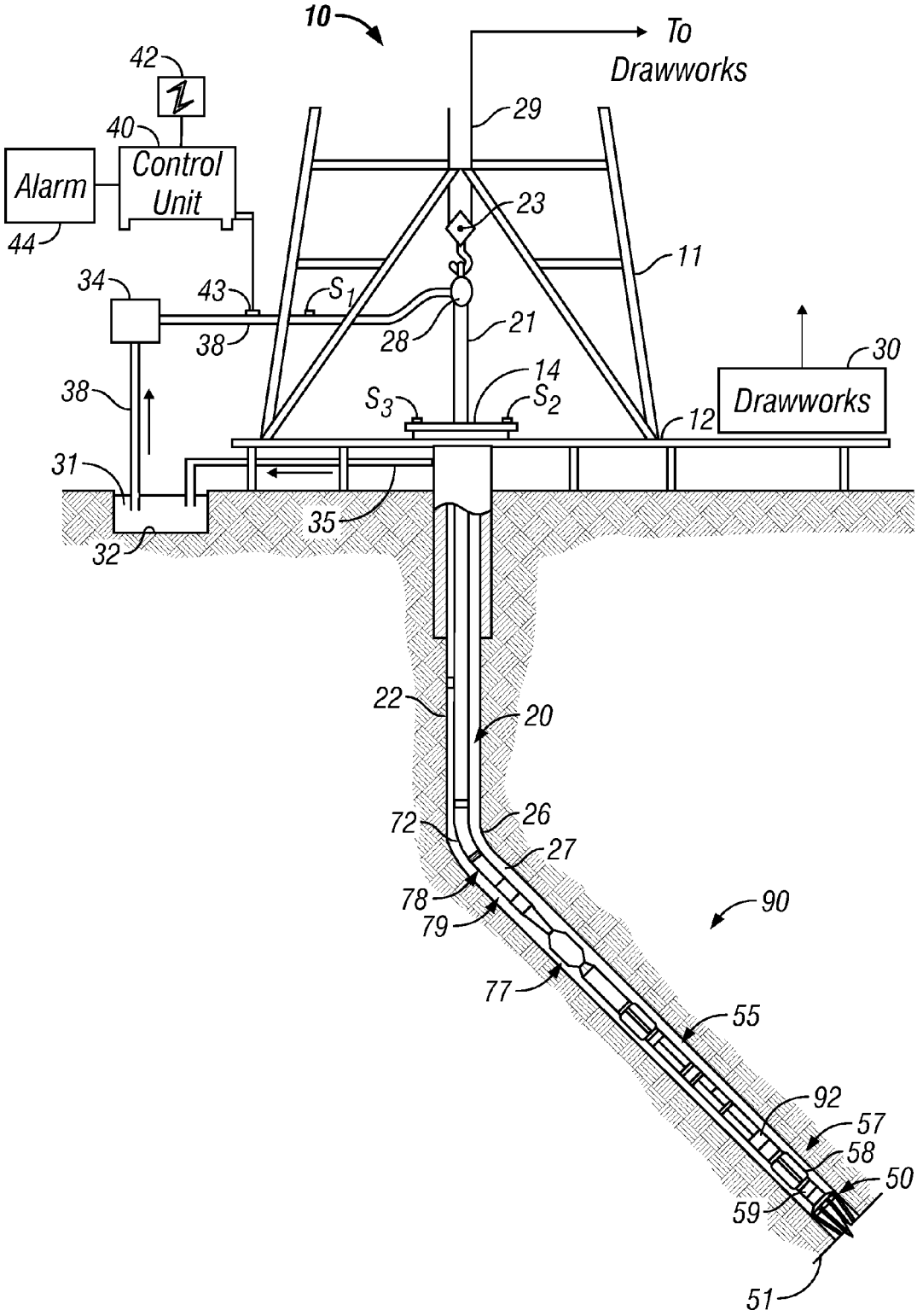
FIG. 1 shows drilling system suitable for use with depth measurement systems made in accordance with embodiments of the present disclosure.

FIG. 1 shows a schematic diagram of a drilling system 10 with a drill string 20 carrying a drilling assembly 90 (also referred to as the bottom hole assembly, or "BHA") conveyed in a "wellbore" or "borehole" 26 for drilling the wellbore. The drilling system 10 includes a conventional derrick 11 erected on a floor 12 which supports a rotary table 14 that is rotated by a prime mover such as an electric motor (not shown) at a desired rotational speed. The drill string 20 includes a wellbore tubular such as a drill pipe 22 or a coiled-tubing extending downward from the surface into the borehole 26. The drill string 20 is pushed into the wellbore 26 when a drill pipe 22 is used as the tubing. For coiled-tubing applications, a tubing injector, such as an injector (not shown), however, is used to move the tubing from a source thereof, such as a reel (not shown), to the wellbore 26. The drill string 20 may include power and/or signal conductors such as wires for providing bi-directional communication and power transmission. One or more such conductors may be positioned inside or outside the drill string 20 or embedded in the walls of the wellbore tubulars making up the drill string 20. The drill bit 50 attached to the end of the drill string breaks up the geological formations when it is rotated to drill the borehole 26. If a drill pipe 22 is used, the drill string 20 is coupled to a drawworks 30 via a Kelly joint 21, swivel 28, and line 29 through a pulley 23. During drilling operations, the drawworks 30 is operated to control the weight on bit, which is an important parameter that affects the rate of penetration. The operation of the drawworks is well known in the art and is thus not described in detail herein.

During drilling operations, a suitable drilling fluid 31 from a mud pit (source) 32 is circulated under pressure through a channel in the drill string 20 by a mud pump 34. The drilling fluid passes from the mud pump 34 into the drill string 20 via a desurger (not shown), fluid line 28 and Kelly joint 21. The drilling fluid 31 is discharged at the borehole bottom 51 through an opening in the drill bit 50. The drilling fluid 31 circulates uphole through the annular space 27 between the drill string 20 and the borehole 26 and returns to the mud pit 32 via a return line 35. The drilling fluid acts to lubricate the drill bit 50 and to carry borehole cutting or chips away from the drill bit 50. A sensor $S_1$ typically placed in the line 38 provides information about the fluid flow rate. A surface torque sensor $S_2$ and a sensor $S_3$ associated with the drill string 20 respectively provide information about the torque and rotational speed of the drill string. Additionally, a sensor (not shown) associated with line 29 is used to provide the hook load of the drill string 20.

In one embodiment of the invention, the drill bit 50 is rotated by only rotating the drill pipe 22. In another embodiment of the invention, a downhole motor 55 (mud motor) is disposed in the drilling assembly 90 to rotate the drill bit 50 and the drill pipe 22 is rotated usually to supplement the rotational power, if required, and to effect changes in the drilling direction.

In one embodiment of the invention, a drilling sensor module 59 is placed near the drill bit 50. The drilling sensor module contains sensors, circuitry and processing software and algorithms relating to the dynamic drilling parameters. Such parameters typically include bit bounce, stick-slip of the drilling assembly, backward rotation, torque, shocks, borehole and annulus pressure, acceleration measurements and other measurements of the drill bit condition. A suitable telemetry or communication sub 72 using, for example, two-way telemetry, is also provided as illustrated in the drilling assembly 90. The drilling sensor module processes the sensor information and transmits it to the surface control unit 40 via the telemetry system 72.

The communication sub 72, a power unit 78 and an MWD tool 79 are all connected in tandem with the drill string 20. Flex subs, for example, are used in connecting the MWD tool 79 in the drilling assembly 90. Such subs and tools form the bottom hole drilling assembly 90 between the drill string 20 and the drill bit 50. The drilling assembly 90 makes various measurements including the pulsed nuclear magnetic resonance measurements while the borehole 26 is being drilled. The communication sub 72 obtains the signals and measurements and transfers the signals, using two-way telemetry, for example, to be processed on the surface. Alternatively, the signals can be processed using a downhole processor 92 in the drilling assembly 90.

The surface control unit or processor 40 also receives signals from other downhole sensors and devices and signals from sensors $S_1$-$S_3$ and other sensors used in the system 10 and processes such signals according to programmed instructions provided to the surface control unit 40. The surface control unit 40 displays desired drilling parameters and other information on a display/monitor 42 utilized by an operator to control the drilling operations. The surface control unit 40 typically includes a computer or a microprocessor-based processing system, memory for storing programs or models and data, a recorder for recording data, and other peripherals. The control unit 40 is typically adapted to activate alarms 44 when certain unsafe or undesirable operating conditions occur.

As will be described in greater detail below, embodiments of the present disclosure may be used to determine a depth of the drill string 20 in the wellbore by using the conductor or conductors associated with the drill string 20.

Figure 2:
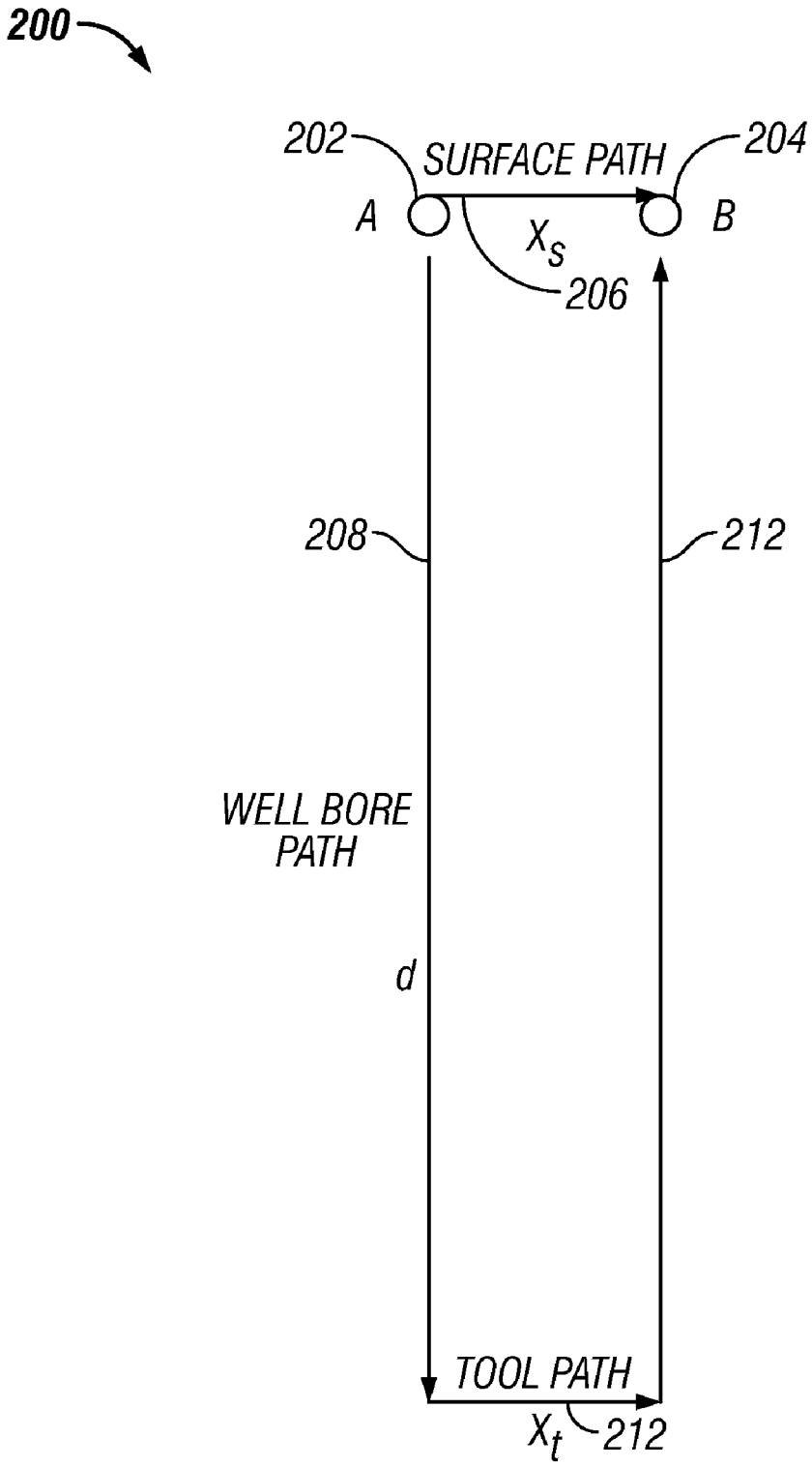
FIG. 2 illustrates a two-path circuit used to estimate a change of length of a wellbore tubular in one aspect of the present disclosure.

In some embodiments, the drill string 20 may include a first conductor available to transmit a signal downhole and a second conductor to transmit a signal uphole. FIG. 2 illustrates a system applicable to arrangements where two such conductors are available. FIG. 2 illustrates a two-path circuit 200 that may be traversed by a set of signals to estimate a change of length of a wellbore tubular in one aspect of the present disclosure. Two paths are provided for a signal to travel from point A 202 to point B 204. The two paths comprise a surface path $x_s$ 206 and a downhole path which includes paths wellbore paths 208 and 212 and tool path $x_t$ 210. A signal traversing a surface path $x_s$ 206 may experience a constant delay which may be due to an internal delay of related surface electronics as well as to a delay relating to a surface distance traveled. A signal traversing the downhole path may experience a signal delay related to distance traveled over paths 208 and 212. Also tool path $x_t$ may provide an internal electronics delay. A change of length of the wellbore path can be detected by comparing signals arriving at point B. This change of length may be cause by stretch, temperature changes, etc.

The change in distance d of path 208 can be determined from comparing the two signals, as explained below. Since an electrical signal travels at a constant rate in a conductor, a signal injected into both surface and downhole paths (at A) will arrive at the end points of the paths (at B) at different times. The travel time t along each path is given by $$t=x/V \tag{1}$$

where x is one of the two paths and V is the signal propagation speed within the wire. For a metal conductor, the speed of propagation is given by V=c/n, where c is the speed of light in a vacuum, and n is the index of refraction of the metal. For typical good conductors n≈2. Consequently, t=x·n/c. By using sine waves with a radian frequency, ω, traveling both paths, the surface signal may be written:

$$A=A_0\sin(\omega t+\delta_s) \quad (2)$$

where $\delta_s$ is a phase shift due to constant internal delay associated with a wave traveling from A to B at the surface, and the wellbore path signal may be written:

$$B=B_0\sin(\omega t+\Omega(d)+\delta_w) \quad (3)$$

where Ω(d) is the change of phase as function of distance d and $\delta_t$ is a phase shift due to constant internal delay for a wave traveling from A to B through the wellbore path.

The change in phase as a function of distance is given by:

$$\Omega(x)=kx \quad (4)$$

where k is generally referred to as the wave number, and in this case x is total distance traveled along the wellbore path. The wave number k is related to the wavelength λ by $$k=2\pi/\lambda \quad (5)$$

where $$\lambda=V/f=c/(nf) \quad (6)$$

Consequently $$k=2\pi nf/c \quad (7)$$

and by substituting Eq. (7) into Eq. (4), the phase $$\Omega(d)=4\pi nfd/c \quad (8)$$

where x=2d. Upon measuring the phase difference, then $$d=c\Omega_m/(4\pi nf) \quad (9)$$

with the only the unknown index of refraction n to be determined. Alternately, the index of refraction can be determined by rearranging Eq. (9) to obtain $$n=c\Omega_m/(4\pi df) \quad (10)$$

and using Eq. (10) with a completely relaxed wire of known length. Alternatively, the index of refraction can be arrived at using a calibration process such as described in U.S. Pat. No. 5,541,587, for example.

Figure 3:
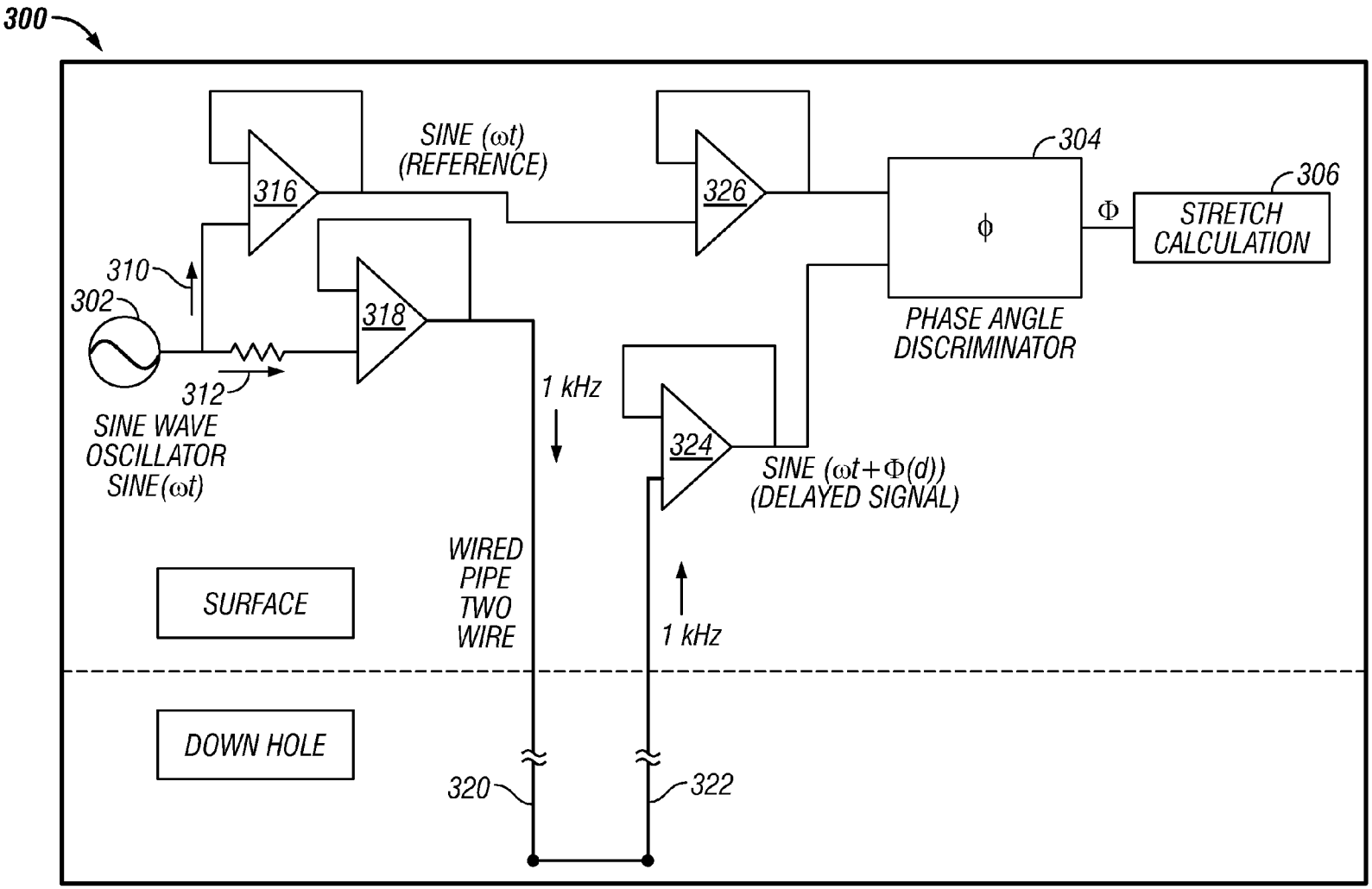
FIG. 3 illustrates a two-wire apparatus of the present disclosure for estimating a stretch measurement of a wellbore tubular.

FIG. 3 illustrates a two-wire apparatus 300 for estimating a stretch measurement of a wellbore tubular. The two wires 320 and 322 correspond to wellbore paths 208 and 212 of FIG. 2, respectively. The two wires are attached to a wellbore tubular and thus experience changes in length corresponding to changes in length of the wellbore tubular, such as the drill string 20 (FIG. 1). The exemplary apparatus 300 comprises a signal generator 302 capable of providing a set of signals, a phase discriminator 304 for calculating a relative phase shift between signals (i.e., surface path and wellbore path signals), and a stretch calculator 306 for estimating a change in wellbore tubular length based on the calculated relative phase shift. In one aspect, the signal generator 302 may be a sine wave oscillator providing a sinusoidal wave at a selectable frequency. A very narrow band signal (i.e. a continuous sine wave) at a sufficiently low frequency is typically used to avoid dispersion effects. Any signal frequency may be used, although a 1 kHz signal is shown herein for illustrative purposes only. The signal provided by the signal generator may be split into two equivalent signals: a reference signal 310 and a delayed signal 312. Reference signal 310 is transmitted over a surface path to arrive at phase discriminator 304 and experiences a delay due to the distance traveled over the surface path and any internal delay due to surface electronics, such as line driver 316 and receiver 326. Delayed signal 312 is transmitted over wires 320 and 322 to arrive at the phase discriminator 304. The delayed signal experiences a delay related to the distance traveled over the wires 320 and 322 and any delay due to internal tool electronics such as line driver 318 and receiver 324. As an illustrative example, the reference signal 310 may arrive at discriminator 304 with waveform sin(ωt) while delayed signal 312 arrives at discriminator 304 with waveform sin[ωt+Φ(d)] where Φ(d) relates to the delay due to the distance the delayed signal travels over the wellbore tubular. The phase discriminator outputs the relative phase between the two signals, which is Φ(d) in this example. The output of the phase angle discriminator may be either analog or digital. The stretch calculator 306 estimates a change in length of the downhole paths 320 and 322 and by extension the change in length of the wellbore tubular based on the relative phase shift.

Figure 4:
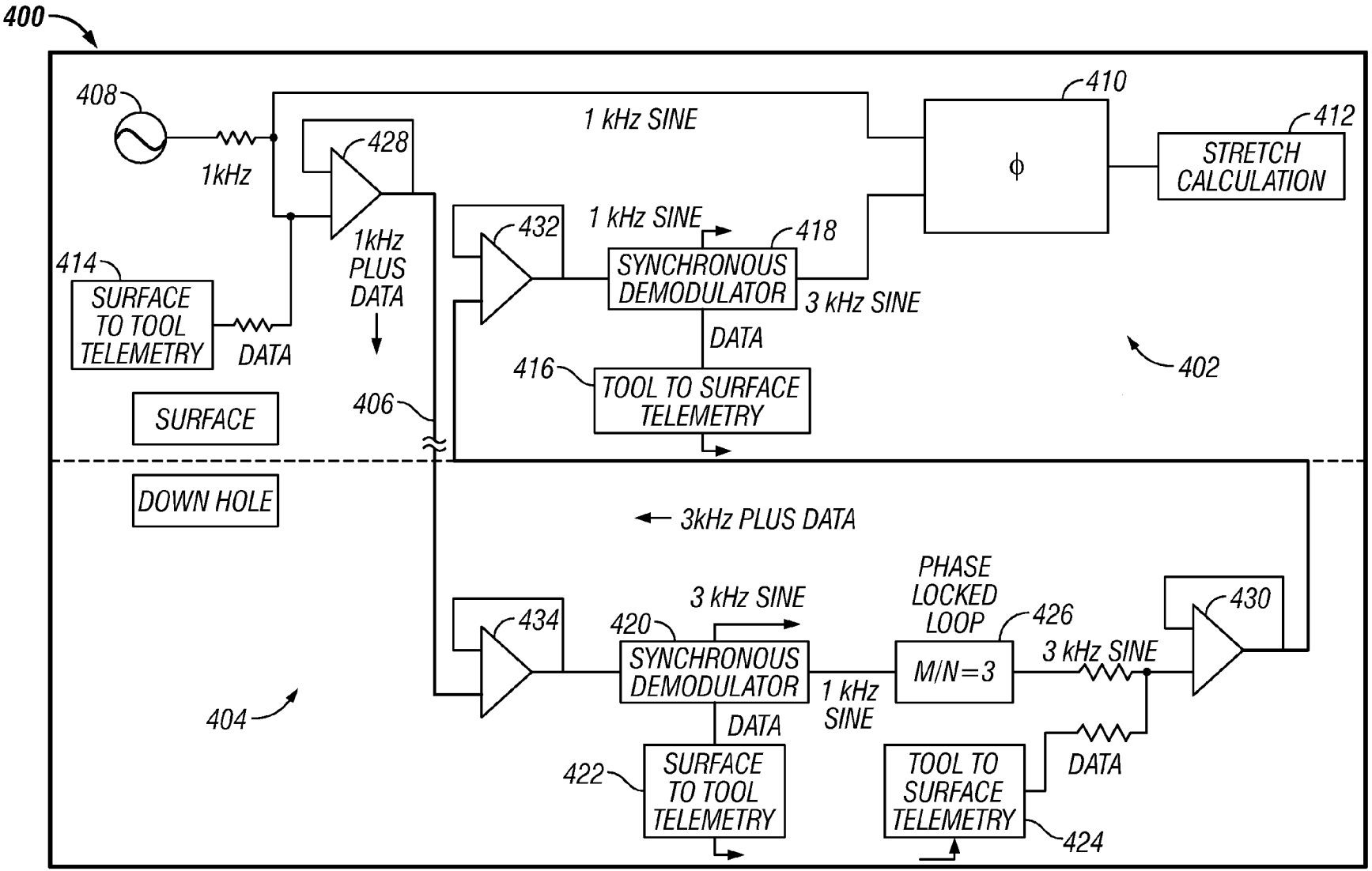
FIG. 4 illustrates a single-wire apparatus of the present disclosure for estimating a stretch measurement of a wellbore tubular.

In some embodiments, the drill string 20 may include only one signal conductor, which may be a pair of conductors, that provides a signal path both downhole and uphole. FIG. 4 illustrates a single-wire apparatus 400 for estimating a stretch measurement of a wellbore tubular provided with a single signal path. The apparatus of 400 comprises surface electronics 402 for generating a test signal and calculating stretch measurements, downhole tool electronics 404 for receiving downward transmitted signals and generating distinguishable return signals, and a single wire 406 that electrically connects the surface and tool electronics. Consequently, single wire 406 carries multiple electric signals, including downward transmitted and upward transmitted measurement signals as well as surface-to-tool and tool-to-surface telemetry signals. These multiple signals typically traverse the single wire simultaneously. Possible confusion between which is the downward transmitted signal and which is the upward transmitted signal is resolved by transmitting a signal down-hole at one frequency and another up-hole signal at a different frequency. As an illustrative example used herein, the downward transmitted measurement signal is a 1 kHz sine wave signal, and the upward transmitted measurement signal is a 3 kHz sine wave signal. The single wire 406 is attached to a wellbore tubular and experiences changes in length corresponding to changes in length of the wellbore tubular.

Surface electronics 402 comprises a signal generator 408, a phase discriminator 410 and a stretch calculator 412, which have the same functionality as the corresponding components in FIG. 3. A signal generator such as a standard 10 ppm oscillator generally provides a level of stability to the apparatus. Additionally, surface electronics comprises various telemetry electronics, such as surface-to-tool telemetry input electronics 414 that transmit telemetry signals downhole and tool-to-surface telemetry output electronics 416 that receives and processes telemetry signals from downhole. A reference signal is sent from the signal generator to the phase discriminator over a surface path. Line driver 428 receives a summation of a telemetry signal and the continuous wave (CW) signal (i.e., the 1 kHz signal) constituting a delayed signal from the signal generator and transmits the summed signal downhole. Receiver electronics 432 receives signals from the downhole electronics and transmits the signal to the synchronous demodulator 418. The synchronous demodulator 418 separates the various signals (i.e., 1 kHz, 3 kHz, telemetry) received at the surface for distribution to appropriate electronics devices. For example, the 3 kHz signal is sent to the phase discriminator 410, and the telemetry signal is sent to the tool-to-surface telemetry output electronics 416. The synchronous demodulator generally discards the 1 kHz signal as it is not used at downstream surface components, such as the phase discriminator. In an alternate aspect, a synchronous filter may be used in place of the synchronous demodulator. In another alternate aspect, various components of functions of the surface electronics may be combined. For example, the synchronous demodulator and the phase discriminator may be combined in one component.

Downhole tool electronics 404 comprises a synchronous demodulator 420 to separate the various signals received from the surface, surface-to-tool telemetry output electronics 422 to receive and process telemetry signals, tool-to-surface telemetry input electronics 424 to transmit telemetry signals uphole, and a phase locked loop 426 that outputs a signal having a phase and frequency corresponding to the phase and frequency of an input signal. Receiver electronics 434 receives the signals (i.e., 1 kHz, 3 kHz, telemetry) from the surface electronics and feeds them to the synchronous demodulator 418. Line driver 430 receives a summed 3 kHz signal and telemetry signals and transmits the summed signals from the tool electronics to the surface. The synchronous demodulator 418 separates the various signals (i.e., 1 kHz, 3 kHz, telemetry) received downhole for distribution to appropriate electronics devices. For example, the synchronous demodulator discards the 3 kHz signal as it is not used at downstream downhole components, such as the phase locked loop 426. The 1 kHz signal is sent to the phase locked loop, and the telemetry signal is sent to the tool-to-surface telemetry input electronics 422.

Typically, the phase locked loop received an input signal and outputs a phase-locked signal having a frequency that is an integer multiple of the input signal and maintains the phase relationship with the input signal, thereby preserving the time delay from the surface to the downhole receiver. For illustrative purposes, the phase locked loop operates using a 3-to-1 frequency ratio and therefore produces a 3 kHz signal in response to the 1 kHz signal of the signal generator 408. Thus every third zero crossing of the 3 kHz output signal coincides with the zero crossing of the 1 kHz signal. The selected ratio of the frequencies is arbitrary, except for having an integer relationship between them.

In another aspect, the phase locked loop may additionally create an output related to two input signals, such as a 5 kHz input and a 3 kHz input. In this case, the phase lock loop system may generate 15 kHz from each of the inputs for comparing their phase. Although additional signal processing errors are possible, phase error cancellation (or reduction) is made possible, leading to a net phase error reduction when compared to the single phase lock loop of FIG. 4. As long as the frequencies are sufficiently low, the first positive or negative 3 kHz zero crossing after the corresponding 1 kHz positive or negative zero crossing will have the proper phase shift, and there will be no signal ambiguity.

The electronic components of FIGS. 3 and 4 will in general be a combination of analog and digital electronics possibly including computer processing. The details of the electronic components will depend to some extent on the nature of the telemetry signal modulation. Extracting phase shift can be performed using various methods and components, such as synchronous filter, FM techniques, a synchronous demodulator and a phase discriminator.

The accuracy of phase shift measurements is discussed below. The phase shift was previously determined in Eq. (8), restated as Eq. (11) below, with variable x in replacing d for clarity.

$$\Omega(x)=4\pi nfx/c. \tag{11}$$

Taking the derivatives of both sides, $$d\Omega(x)=(4\pi nf/c)dx \tag{12}$$

Therefore, for a given dx, $$d\Omega(x) \approx 0.08383\frac{\mu\text{Rad}}{\text{Hz}\cdot m}\cdot f\cdot dx, \tag{13}$$

where n=2 is used for the conductor. According to Eq. (13), to achieve a 1 cm accuracy, at 1 kHz, 10 kHz, 100 kHz and 1 MHz, the phase shift is given by 0.8383 μRad, 8.383 μRad, 83.83 μRad, and 838.3 μRad, respectively. Although higher frequencies give higher phase shifts, a low frequency may be chosen so as not to exceed the highest frequency supported by the wired pipe. Assuming the speed of propagation is constant regardless of the stretch-squeeze on the drill string, change in propagation delay is due only to the physical change in length of the wire.

As described in U.S. Pat. No. 5,541,587, a bandwidth of approximately 0.05 Hz may be adequate to determine a cable stretch. Tool motion above 0.05 Hz can be accurately described by accelerometer measurements. Using methods discussed in that patent, a flat transfer function response can be achieved over the frequency range from 0 Hz (DC) to the (possibly filtered) cut off frequency of the accelerometer.

The present disclosure may be used on various wireline embodiments, such as wireline cable, segmented wired pipe, etc. Application of the present disclosure varies depending on the type of wireline used. In a wireline cable, the exact length of a long continuous cable is frequently not known. Useful information may still be obtained. Given sine waves with a radian frequency, ω, traveling from point A to point B (see FIG. 2) at the surface:

$$A=A_0\sin(\omega t+\delta_s) \tag{14}$$

A wave traveling from A to B through the wellbore path can be written as $$B=B_0\sin(\omega t+\Omega(d)+\delta_w) \tag{15}$$

In the wellbore path case (Eq. (15)), the signal experiences a shift of $\Omega(l_0)+\delta_w$, where $l_0$ is the initial length of the wire. Also, for a change Δl, the wave traveling the wellbore path is:

$$B=B_0\sin(\omega t+\Omega(\Delta l)+\Omega(l_0)+\delta_w) \tag{16}$$

where Ω(Δl) is the phase change due to a change in length of the cable. The initial relative phase shift can be determined by measuring the phase shift at a fixed location, such as the Kelly joint (21, FIG. 1). The relative phase is then given by $$\Omega_0=\Omega(d)+\delta_w-\delta_s \tag{17}$$

where $\Omega_0$ is the phase difference caused by the wire initial cable length and the static delays within the surface and down-hole systems. From this $$A=A_0\sin(\omega t) \tag{18}$$

$$B=B_0\sin(\omega t+\Omega(\Delta l)+\Omega_0) \tag{19}$$

Once the phase shift is measured and used to estimate the change in length, the change of length may be added to the current depth measurement from the surface depth feed measurement to obtain a total length. All of the observed phase shift is attributable to total change in cable length due to the cable loading. With rare exception, the cable is always under tension and therefore the cable is always stretched.

In the case of a wired pipe, a wired pipe comprises segmented pipe stands. These segmented pipe stands have certain aspects that should be considered with respect to measuring the change of length. During drilling, additional pipe segments are added to the wired pipe as the wellbore deepens.

A typical pipe is about 10 m (30 ft.) in length. A combination of three pipes is generally referred to as a pipe stand. A single-wire carrying signals along the wired pipe necessarily changes length as the pipe length changes. In aspects of the present disclosure, the single wire is under tension regardless of the temperature and compressional load on the pipe in order to obtain correct measurements, since a slack wire can not record a compression. Thus, in embodiments, a conductor may be installed into a pipe segment with a pre-tension that ensure that the conductor will not transition into a slack condition. In other embodiments, a suitable biasing element may be used to maintain a sufficient tensile loading on the conductor. The biasing element may include appropriate stops, guards or other elements that prevent the biasing element from introducing a stretch change under loading or due to temperature. That is, preferentially, the stretch on the conductor should be due entirely to the pipe itself. However, this may be impossible due to physical constraints, in which case, any stretch error (specifically, differences between the conductor stretch and pipe stretch) should be much smaller than the pipe stretch. Typically, the length of the conductor used in wired pipe changes in large discrete steps, the minimum step being one pipe section. However, a more common discrete step comprises a pipe stand.

To obtain a phase equation usable for wired pipe, note that the wireline solutions obtained for change in length are:

$$\Omega_0=\Omega(d)+\delta_w-\delta_s \tag{20}$$

$$A=A_0\sin(\omega t) \tag{21}$$

$$B=B_0\sin(\omega t+\Omega(\Delta l)+\Omega_0). \tag{22}$$

For the first pipe stand, the phase shift is:

$$\Omega(l)=\Omega(\Delta l)+\Omega(L)+\delta_w-\delta_s \tag{23}$$

where L is the initial length of the pipe stand and $\Omega(L)$ is the phase difference due to the length of the pipe stand. $\Delta l$ is a change in the length of the pipe stand, and $\Omega(\Delta L)$ is the phase shift corresponding to the change in the length of the pipe stand. When a second pipe stand is added, the phase shift becomes $$\Omega(l)=\Omega(\Delta l)+\Omega(L_1)+\Omega(L_2)+\delta_w-\delta_s \tag{24}$$

where the subscripts have been added to the lengths of each stand to indicate that the lengths might not be the same. Thus, for N pipe stands the phase shift equation becomes $$\Omega_N(l)=\Omega(\Delta l)+\sum_{i=1}^{N}\Omega(L_i)+\delta_w-\delta_s \tag{25}$$

when $\Omega_N(l)$ is the total phase shift caused by the drill sting of length l at the $N^{th}$ pipe stand including stretch. The last three terms on the right hand side of Eq. (25) are the net initial phase shifts due to the length of the drill string and constant internal delays of the wellbore and surface paths, respectively. The term $$\Omega(L_i)=4\pi nfd/c \tag{26}$$

is the phase shift added by the $i^{th}$ pipe stand.

Ignoring stretch, the 'relaxed' length of the wired pipe is $$L_0=\sum_{i=1}^{N}L_i \tag{27}$$

where $L_i$ are the lengths of unloaded pipe stands, and $$L_i=c\Omega_{mi}/(4\pi nf) \tag{28}$$

where $\Omega_{mi}$ is the initial phase shift of the ith pipe stand.

In the wired pipe case, the length of the pipe string changes by a discrete amount when a pipe stand is added, and the phase shift also changes by a corresponding discrete amount. When the pipe stand is added, the additional phase shift associated with the added pipe stand is added to the phase shifts of all the other pipe stands in the pipe string plus any phase shift due to stretch and squeeze (compression).

Unless the electronics is on a battery or battery back-up, downhole power is lost when a pipe stand is added. Steps are taken to address that the electrical path downhole is broken. The length of each pipe stand, the change in phase caused by each pipe stand, the index of refraction for the wire and downhole power are all factors in obtaining measurements on the wired pipe problem.

Depending on the electronics implementation, downhole power may not be required to be continuous through a pipe change or possibly even while drilling. However, generation and transmission of the up-going sine wave does required power. Using PLL (Phase Locked Loop) technology, the sine waves and their corresponding phase shifts should be recoverable after a power interruption—the PLL just have to reacquire their phase-locked operation. If a battery backup system is not available, the drill string is held stationary until the downhole power is restored and the phase shifts are stable.

Prior to the addition of a new pipe stand, the last valid phase measurement is retained. The last phase measurement consists of the phase shifts caused by the cumulative phase shifts of all of the pipe stands currently in the well, and the phase shift caused by the combined stretch-squeeze in a manner distributed throughout the string. The new pipe stand is added such that the new phase measurement change is entirely due to the current length of the added pipe stand under its current load or lack of load. The length of the $N^{th}$ stand should be measured after it is installed into the pipe string, concurrently with the new phase shift measurement. If the length $L_N$ of the $N^{th}$ stand is measured in-situ, $$\Omega(L_N)=\Omega_m-\Omega_p \tag{29}$$

where N is the new number of stands in the string, and M and P refer to the current and previous measurements.

The index of refraction can be determined from the length of the pipe stand. Several independent techniques are available, e.g., surveying methods, range finders to determine pipe stand length to determine pipe length. The pipe stand length measurements are typically obtained in-situ under load conditions. The index of refraction of the wire can be computed for each stand using $L_N$, the last stand, by $$n=c\Omega_m/(4\pi L_N f). \tag{30}$$

If the variation is small enough (e.g. below the accuracy of the phase measurement), then the index of refraction from each pipe stand may be averaged to create a statistical estimate of the 'effective' index of refraction of the total wire.

One of the depth corrections applied to the drill pipe total length is pipe sag. Pipe sag will change the length of the wire within the pipe and the amount of change will depend on where the wire is located within the current pipe joint. However, for applications where the MWD/LWD system is acquiring azimuthal data the entire tool string is rotating to provide the 'raster' scan of the formation. This rotation rate generally ranges from 30 to 200 RPM or 0.5 to 33.3 RPS. If the bandwidth of the PLLs is approximately 0.05 Hz, then the effect of pipe sag will not significantly effect the phase measurement. More specifically, the effects of pipe sage will average out.

Figure 5:
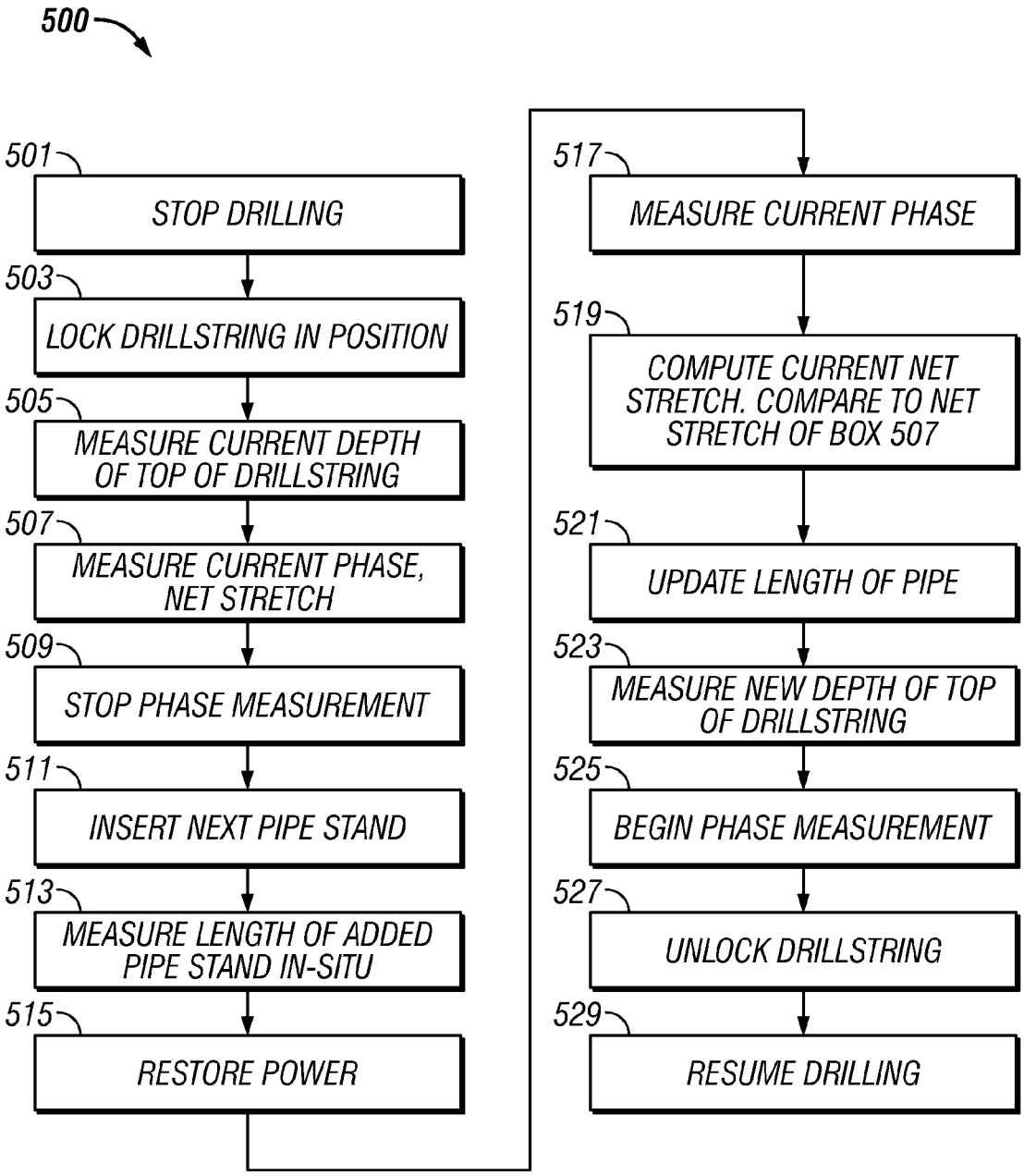
FIG. 5 shows a flowchart of a method the present disclosure of for obtaining correct phase shifts during the addition of a new pipe into a pipe string.

FIG. 5 shows a flowchart outlining a method for obtaining correct phase shifts during the addition of a new pipe into a pipe string. To better illustrate the exemplary method, reference will be made to FIG. 1, which depicts a drilling system 10 that may utilize the described depth measurement techniques. Measurements, determinations or calculations referred to in FIG. 5 may be performed by the surface control unit 40 and/or the downhole processor 92.

Referring now to FIGS. 1 and 5, in Box 501, drilling conducted by the drilling system 10 is temporarily stopped. In Box 503, the drill string 20 is locked in position. A measurement of the current depth of the top of the drill string 20 is made in Box 505 with respect to a reference point. This measurement may be a negative number. In Box 507, a measurement is made of the current phase, and a current net stretch is computed. In Box 509, phase measurements are stopped. Also, mud circulation may be stopped if required. In Box 511, the next pipe stand is inserted. The length of the added pipe stand is measured in-situ in Box 513. Mud circulation may be restored if stopped earlier, and power is restored to the apparatus in Box 515. Power restoration may be seen when a stable power levels and stable phase shift is achieved. In Box 517, the current phase is measured. The phase shift caused by the new pipe stand is computed, and the effective index of refraction is updated. In Box 519, the current net stretch is computed. This current net stretch is compared to the net stretch obtained in Box 507. These values should be the same because the added pipe stand is considered to be un-stretched. In Box 521, the total length of the pipe string is updated. This length should be close to a length obtained from a pipe tally. In Box 523, the new depth of the top of the string 20 is measured with respect to the reference point used in Box 505. Again, this number may be negative. This new depth should match the previous measured depth. In Box 525, phase measurement is begun. In Box 527, the drill string is unlocked. In Box 529, drilling is resumed.

The method of FIG. 5 assumes that there is no electronics in the wired pipe. A repeater is a pass-through line driver that restores the input signal to a predetermined output level to compensate for transmission losses along the conductor. If the wired pipe section has a repeater the, Box 517 (step 13*b*) is skipped, and the effective index of refraction is not updated. The pipe stand signal delay is then attributed to the internal wire length plus the repeater delay. This model assumes that the delay through a repeater is constant.

The measured depth can be obtained from the information obtained herein. As the drilling progresses, the entire drill string moves downhole. Generally, the movement downhole is defined by a surface measurement of Rate of Penetration, ROP, usually expressed in m/hr or ft/hr. The ROP can be obtained by several methods, e.g. by measuring the cable feed from the drawworks (with possibly non-linear corrections), by a laser range finder, and by survey methods. Ultimately, the ROP is determined by measuring the change in depth over a specific time interval. Observing the equations:

$$\Omega_N(l) = \Omega(\Delta l) + \sum_{i=1}^{N} \Omega(L_i) + \delta_w - \delta_s \tag{31}$$

$$L_i = c\Omega_{m_t} / (4\pi n f)$$

where $$L_0 = c\sum_{i=1}^{N} \Omega(L_i) / (4\pi n f) \tag{32}$$

is the total initial length of the drill string, then $$L = c\Omega(\Delta l)(4\pi n f) + L_0 \tag{33}$$

is the 'loaded' length of the drill string. The measured depth of the drill string is determined from the actual displacement of the tool string relative to a reference point. The top of the drill string, for example, can be used as the reference point. Placing the top of the drill string at a depth z above the reference (z may be negative), then the bottom of the drill string, $M_0$ is given by $$M_D = z + c\Omega(\Delta l)(4\pi n f) + L_0 + z_R \tag{34}$$

where the term $z_R$ is added to account for a tool string bottom reference that is not at the bit. The second term on the right hand side of Eq. (34) is the change in length of the drill string due to the net distributed load on the bit:

$$\Delta L = c\Omega(\Delta l)/(4\pi n f) \tag{35}$$

Eq. (34) provides the measured depth from the borehole reference to the tool string reference. If $z_R$ is located at a particular sensor, then the measure depth is the depth of the sensor at the time measured depth is obtained.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A method of estimating a change in length of a wellbore conveyance device in a wellbore, comprising:

generating a reference signal;

sending the reference signal along a wellbore path along the wellbore conveyance device to obtain a delayed signal; and estimating a change in length of the wellbore conveyance device from a phase shift between the reference signal and a delayed signal due to the reference signal traveling along a surface path and the phase shift between the reference signal and a delayed signal due to the reference signal traveling along a wellbore path.

2. The method of claim 1, further comprising using one of (i) a single wire and (ii) at least two wires for the wellbore path.

3. The method of claim 1, further comprising changing a frequency of the wellbore signal downhole.

4. The method of claim 3, wherein the changed frequency is an integer multiple of the frequency of the reference signal.

5. The method of claim 1, wherein the wellbore conveyance device further comprises a wellbore tubular having at least one conductor.

6. The method of claim 5, further comprising maintaining a tension on the at least one conductor.

7. The method of claim 1 further comprising estimating a length of the wellbore conveyance device from the estimated change in the length.

8. An apparatus for estimating a change in length of a wellbore conveyance device in a wellbore, comprising:

a signal generator configured to generate a reference signal and send the reference signal along a path in the wellbore;

a phase angle discriminator configured to estimate a phase shift between the reference signal and a signal delayed by the wellbore path; and a processor configured to estimate a change in length of the wellbore conveyance device from the estimated phase shift between the reference signal and a delayed signal due to the reference signal traveling along a surface path and the estimated phase shift between the reference signal and a delayed signal due to the reference signal traveling along a wellbore path.

9. The apparatus of claim 8, further comprising at least one signal conductor receiving the reference signal from the signal generator, the at least one signal generator being positioned along the path in the wellbore.

10. The apparatus of claim 9, wherein the at least one signal conductor is a single signal conductor configured to convey the reference signal downhole and uphole.

11. The apparatus of claim 8 further comprising a phase locked loop positioned in the wellbore and receiving the reference signal from the signal generator, the phase locked loop being configured to change a frequency of the received signal downhole.

12. The apparatus of claim 11, wherein the changed frequency is an integer multiple of the frequency of the reference signal.

13. The apparatus of claim 8, wherein the wellbore conveyance device is a wellbore tubular.

14. The apparatus of claim 8, wherein the processor further estimates a length of the wellbore conveyance device from the estimated changes in the length.

15. A method for determining a length of a drill string in a wellbore, comprising:

forming the drill string using a plurality of wellbore tubulars having at least one signal conductor;

drilling the wellbore with the drill string;

sending a signal along the at least one signal conductor;

determining a phase shift between the signal sent along the at least one signal conductor and a reference signal; and estimating a length of the drill string using the determined phase shift between the reference signal and a delayed signal due to the reference signal traveling along a surface path and the phase shift between the reference signal and a delayed signal due to the reference signal traveling along a wellbore path.

16. The method of claim 15 further comprising sending the reference signal along the at least one signal conductor.

17. The method of claim 15 wherein the at least one conductor includes a single conductor and wherein the signal is sent downhole and uphole along the single conductor.

18. The method of claim 15 further comprising:

adding a wellbore tubular to the drill string: and determining a phase shift of the drill string with the added wellbore tubular.

19. The method of claim 18 further comprising determining a length of the wellbore tubular added to the drill string; and updating a recorded length of the drill string.

20. The method of claim 19 further comprising:

stopping drilling before adding the wellbore tubular to the drill string;

determining a phase shift of the drill string after the wellbore tubular has been added to the drill string; and continuing drilling after adding the wellbore tubular to the drill string.

* * * * *